US010454169B2

(12) United States Patent
Jamaly

(10) Patent No.: US 10,454,169 B2
(45) Date of Patent: Oct. 22, 2019

(54) ANTENNA APPARATUS AND METHOD

(71) Applicant: KATHREIN-WERKE KG, Rosenheim (DE)

(72) Inventor: Nima Jamaly, Berne (CH)

(73) Assignee: Kathrein SE, Rosenheim (DE)

( * ) Notice: Subject to any disclaimer, the term of this patent is extended or adjusted under 35 U.S.C. 154(b) by 149 days.

(21) Appl. No.: 15/517,986

(22) PCT Filed: Oct. 9, 2015

(86) PCT No.: PCT/EP2015/073489

§ 371 (c)(1),
(2) Date: Apr. 10, 2017

(87) PCT Pub. No.: WO2016/055657

PCT Pub. Date: Apr. 14, 2016

(65) Prior Publication Data

US 2018/0241124 A1 Aug. 23, 2018

(30) Foreign Application Priority Data

May 1, 2015 (GB) ..... 1507582.3

(51) Int. Cl.
*H01Q 1/48* (2006.01)
*H01Q 5/55* (2015.01)
(Continued)

(52) U.S. Cl.
CPC ..... *H01Q 5/55* (2015.01); *H01Q 1/48* (2013.01); *H01Q 9/40* (2013.01); *H01Q 13/02* (2013.01);
(Continued)

(58) Field of Classification Search
CPC .. H01Q 5/55; H01Q 1/49; H01Q 1/48; H01Q 9/40; H01Q 13/02; H01Q 13/085; H01Q 15/18; H01Q 21/24
See application file for complete search history.

(56) References Cited

U.S. PATENT DOCUMENTS 4,571,593 A 2/1986 Martinson
4,651,115 A 3/1987 Wu
(Continued)

FOREIGN PATENT DOCUMENTS

JP S59-5705 A 1/1984
WO WO 98/04016 1/1998

OTHER PUBLICATIONS

International Search Report for PCT/EP2015/073489 dated Apr. 22, 2016, 7 pages.
(Continued)

*Primary Examiner* — Graham P Smith
(74) *Attorney, Agent, or Firm* — Nixon & Vanderhye P.C.

(57) ABSTRACT

An antenna comprises at least one antenna element arranged in a recess of a ground conductor. A wall of the recess is arranged so that the recess tapers outward from a narrow base inside the recess to a broader mouth. The wall is configured to provide a ground plane for the at least one antenna element. The at least one antenna element comprises a conductive plate arranged perpendicular to the mouth of the recess and to the wall and arranged to provide a slot between the edge of the at least one antenna element and the wall of the recess.

16 Claims, 10 Drawing Sheets

(51) Int. Cl.

| | |
|---|---|
| ***H01Q 9/40*** | (2006.01) |
| ***H01Q 13/02*** | (2006.01) |
| ***H01Q 13/08*** | (2006.01) |
| ***H01Q 15/18*** | (2006.01) |
| ***H01Q 21/24*** | (2006.01) |

(52) U.S. Cl.
CPC ..... *H01Q 13/085* (2013.01); *H01Q 15/18* (2013.01); *H01Q 21/24* (2013.01)

(56) References Cited

U.S. PATENT DOCUMENTS

| | | | |
|---|---|---|---|
| 5,317,329 | A | 5/1994 | Hatasa |
| 5,748,153 | A | 5/1998 | McKinzie, III et al. |
| 6,348,898 | B1 | 2/2002 | Rosenbury et al. |
| 6,351,246 | B1 | 2/2002 | McCorkle |
| 2002/0163397 | A1 | 11/2002 | Buck |
| 2003/0210197 | A1 | 11/2003 | Cencich et al. |
| 2004/0150579 | A1 | 8/2004 | Dotto et al. |
| 2004/0196196 | A1 | 10/2004 | Stiller et al. |
| 2011/0102284 | A1* | 5/2011 | Brown ..... H01Q 13/085 343/767 |
| 2012/0154221 | A1 | 6/2012 | McCorkle |
| 2014/0306851 | A1 | 10/2014 | Hall et al. |

OTHER PUBLICATIONS

International Preliminary Report on Patentability for PCT/EP2015/073489 dated Jan. 18, 2017, 19 pages.
Combined Search and Examination Report for GB1418497.2 dated Nov. 11, 2014, 9 pages.
Examination Report for GB1418497.2 dated Feb. 28, 2017, 5 pages.
Report on Telephone Conversation with Examiner for GB1418497.2 held Jul. 2, 2015, 1 page.
Report on Telephone Conversation with Examiner for GB1418497.2 held Dec. 15, 2016, 1 page.
English translation of Notification of the First Office Action dated Jan. 4, 2019, issued in Chinese Application No. 201580027101.0, 1 page.
English translation of Search Report dated Apr. 10, 2019, issued in related Russian Patent Application No. 2017115652/28(027158), 2 pages.

* cited by examiner

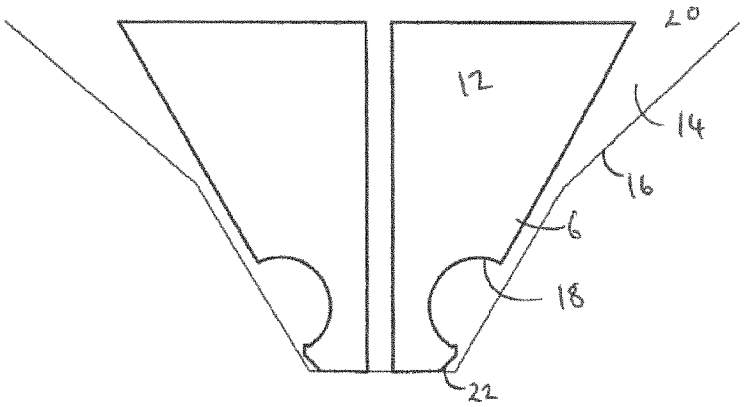
Figure 3-B
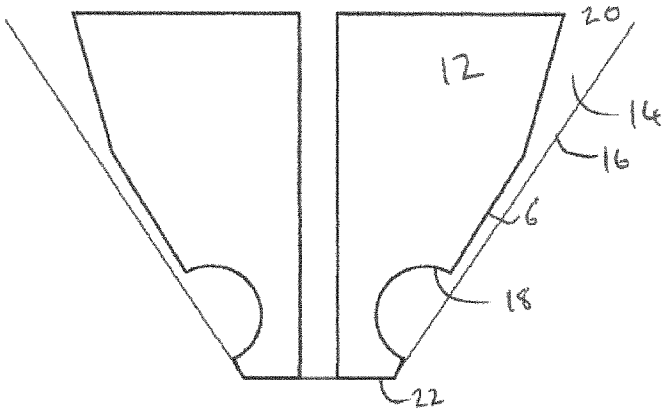
Figure 3-D
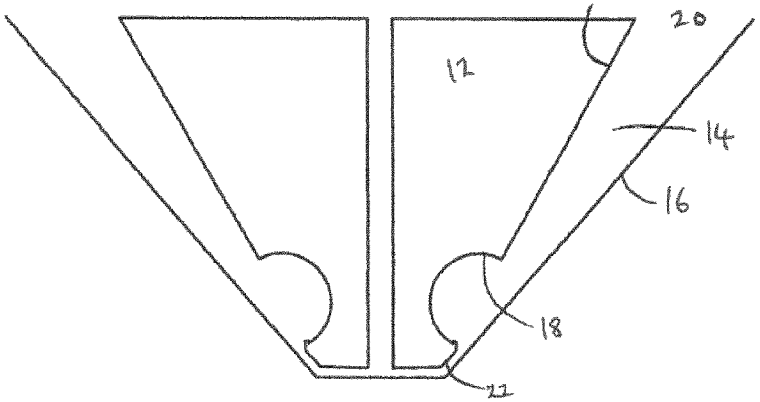
Figure 3-A
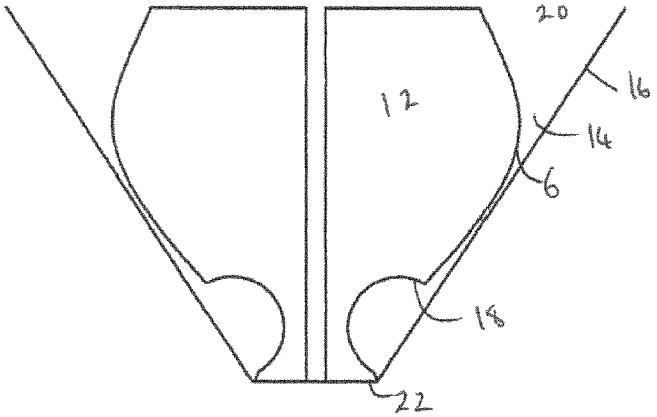
Figure 3-C

ANTENNA APPARATUS AND METHOD

STATEMENT REGARDING FEDERALLY SPONSORED RESEARCH OR DEVELOPMENT

None.

CROSS-REFERENCE TO RELATED APPLICATIONS

This application is the U.S. national phase of International Application No. PCT/EP2015/073489 filed Oct. 9, 2015; which claims priority to European Patent Application No. 14188557.4 filed Oct. 10, 2014; United Kingdom Patent Application No. 1418497.2 filed Oct. 17, 2014; United Kingdom Patent Application No. 1507582.3 filed May 1, 2015; and United Kingdom Patent Application No. 1510361.7 filed Jun. 12, 2015. The disclosures of these prior applications are incorporated herein in their entirety by reference.

FIELD OF THE INVENTION

The present invention relates to telecommunications antennae, and to particular arrangements of such antennae, and methods of providing them. In particular the disclosure relates to slot antennae, such as Vivaldi antennae and other kinds of slot antennae, and to the installation of such antennae.

BACKGROUND

It has been proposed to use slot antennae for telecommunications.

A Vivaldi antenna is one example of slot antenna. In a Vivaldi antenna a slot may be terminated at one end by a circular cut-out in a conductor, this cut-out may have a diameter which is greater than the width of the slot. The slot is generally open at its other end, and may have a curved tapered profile so that it broadens out towards this open end, the width of this slot may be an exponential function of position along the length of the slot.

SUMMARY OF INVENTION

Aspects and examples of the invention are set out in the claims.

BRIEF DESCRIPTION OF DRAWINGS

Embodiments of the disclosure will now be described, by way of example only, with reference to the accompanying drawings, in which:

FIG. 3 includes a series of schematic section views of antennae shown in FIGS. 3-A, 3-B, 3-C and 3-D;

In the drawings like reference numerals are used to indicate like elements.

SPECIFIC DESCRIPTION

Figure 1:
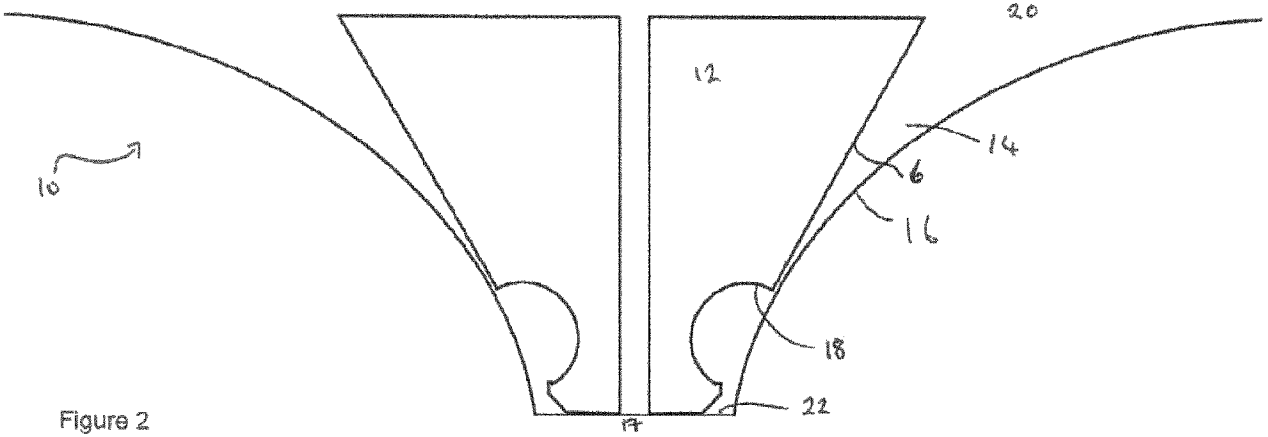
FIG. 1 shows a schematic illustration of a section through an antenna.

The drawings of FIG. 1 to FIG. 5 all relate to telecommunications antennas comprising a slot antenna element 12 arranged in a recess. A wall 16 of the recess provides a ground plane for the antenna element 12. The antenna element 12 comprises a flat conductor, for example a conductive sheet or plate, at least part of an edge 6 of this conductor is spaced apart from the wall 16 of the recess. The spacing between the edge 6 of the antenna element 12 and the wall 16 of the recess provides a slot 14 which can be excited by the application of an electrical signal so that the antenna element 12 and the wall 16 of the recess together behave as a slot antenna. For example, the antenna element 12 may be one half of a slot antenna, and the image effect may cause the antenna element 12 and an image antenna element on the ground plane to behave as, or to approximate the behaviour of, a complete slot antenna. The shape and size of the slot, as well as the driving frequency of the signal with which the antenna element is driven may determine the radiation pattern. These parameters may also determine the E-field configuration over the slot which in turn may determine the eventual far field radiation pattern from the antenna.

The antenna element 12 may comprise a half-Vivaldi antenna element 12. For example, the edge 6 of the antenna element 12 and/or the wall 16 of the recess may be curved so that the spacing between the edge 6 and the wall 16 of the recess (e.g. the width of the slot 14) is an exponential function of position along the slot 14. In some examples the antenna element 12 may comprise a part-circular "cut-out" sector 18 arranged towards a closed end 22 of the slot in the interior of the recess. It will be appreciated in the context of the present disclosure that the function of the "cut-out" is to present a higher impedance path to signals in the antenna bandwidth than is presented by the conduction path towards the open end of the slot, accordingly any functionally equivalent impedance tuning structure can provide this function.

In operation an image antenna, an electrical mirror-image of the antenna element 12, may be provided by the reflection of signal from a wall 16 of the recess. This image antenna may contribute to the radiation pattern of the antenna, for example the signal from the antenna may comprise two contributions: the waves that travel directly from the antenna element 12 to that point, and the waves that reach that point from the antenna after reflecting off the ground plane provided by the wall of the recess. Because of the reflection, these second waves appear to come from a second antenna behind the ground plane, just as a visible object in front of a flat mirror forms a virtual image that seems to lie behind the mirror. This second apparent source of radio waves may be referred to as an image antenna element. It will be appreciated in the context of the present disclosure that the tangential electric field at the (conductive) surface of the recess may generally be zero, and the reflection of electromagnetic fields from this surface may be governed by this boundary condition.

As noted above, the antenna element 12, and the corresponding image antenna element may behave together as a slot antenna. The slot 14 is generally directed towards the mouth of the recess, for example a closed end 22 of the slot 14 may be arranged towards the interior of the recess and the open end 20 of the slot 14 may arranged towards the mouth of the recess.

A plurality of antenna elements 12 may be arranged in the recess and may be driven independently so as to provide multiple input and/or output channels, for example the antenna may be arranged to provide one input and/or output channel per antenna element 12. The shape of the edge 6 of the antenna elements and/or the form of the wall 16 of the recess may be selected to shape the radiation pattern, for example to adjust the angle of elevation of a centre of intensity of the radiation pattern with respect to the antenna, for example a maximum of the radiation pattern. Having read the present disclosure, a person skilled in the art will recognize that the pattern may also be changed dynamically or statically by exciting the different antenna elements 12, 12' with suitable electrical signals.

Figure 2:
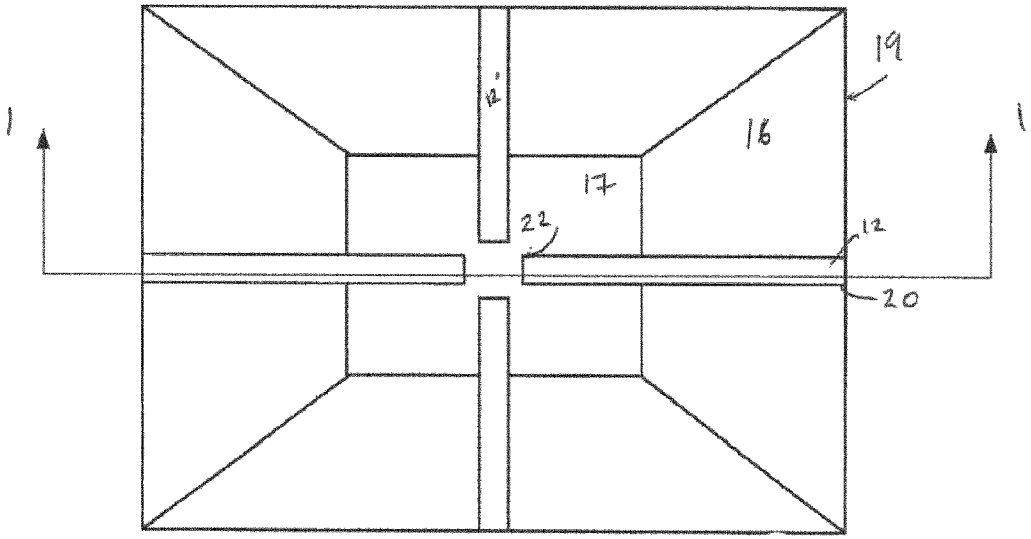
FIG. 2 shows a schematic illustration of a plan view of the antenna of FIG. 1.

FIG. 1 shows a section view of the antenna shown in plan in FIG. 2. The section of FIG. 1 represents the view along the line 1-1 illustrated in FIG. 2.

The telecommunications antenna illustrated in FIG. 1 and FIG. 2 comprises four antenna elements 12, 12' arranged in a recess. As illustrated in the plan view shown in FIG. 2, the antenna elements 12, 12' may be directed away from each other. For example, the antenna elements 12, 12' may be aligned in different azimuthal directions, for example they may be directed in orientations which differ by at least 90° as illustrated in FIG. 2.

The recess may have an open mouth 19 (e.g. the perimeter of the recess), and sloping walls 16 which taper inwards from the mouth towards a closed base 17 as illustrated in FIGS. 1 and 2, and arranged to provide a ground plane for the antenna, for example the walls 16 and base 17 of the recess may be provide by a conductor which may be grounded. The recess may be wider at its mouth 19 than its base 17, for example the recess may be tapered outward from a narrow (closed) base 17 towards a broader, open, mouth 19. The walls of the recess may slope inwards from this open mouth. The walls of the recess however may be curved as shown in FIG. 1, and may have a negative curvature.

As shown in FIG. 2, each antenna element 12 comprises a flat conductor having first and second major surfaces, which may be perpendicular to one of the walls of the recess, and may also be perpendicular to the mouth of the recess. For example the antenna elements may stand upright in the recess, and the edges of each antenna element 12 may be aligned so the antenna element 12 is directed out (e.g. radially) from the interior of the recess (e.g. near its centre) towards its periphery.

The edge 6 of each antenna element 12 that is closest to the wall 16 of the recess is spaced apart from that wall 16 along at least a part of its length. As explained above, this spacing provides a slot 14 between this adjacent edge 6 and the wall 16. The slot 14 can be driven as an antenna for transmitting and receiving signals by exciting the antenna elements 12, 12' with an electric signal. The image effect provided by the electrical mirror image of the antenna element 12 in the ground plane may provide a radiation pattern corresponding to that associated with a slot antenna.

In the example illustrated in FIG. 1 the slot 14 of each antenna element 12 is closed at the end nearest to the centre of the recess, for example the end of the antenna edge 6 that is closer to the interior (e.g. the centre) of the recess may be DC coupled to the wall 16 of the recess, for example it may be grounded, for example by a conductive (e.g. DC conductive) coupling, for example to the base 17 of the recess. This closed end 22 of the slot 14 may also comprise an impedance tuning structure, such as the "cut-out" in the edge 6 of the antenna that is adjacent the wall 16 of the recess. As explained above this structure may be a part-circular "cut-out" 18 and may be arranged between the DC ground at the closed end 22 of the slot 14 and the open end 20 of the slot 14 and may be towards, (for example at) the closed end 22 of the slot 14.

The radius of this part-circular sector 18 may be a function of various desired antenna characteristics. For example, the radius of the part-circular sector 18 may be selected based on a dominant or centre frequency of a communication frequency band of the antenna.

The other end of the slot 14 may be open, for example the slot 14 may be tapered so that the edge 6 of the antenna element 12 is separated from the wall 16 of the recess by a gap that is narrower towards the interior (closed) end 22 of the slot 14 than toward the open end 20 of the slot 14 directed towards the mouth of the recess. At least part of the edge 6 of the antenna element 12 may be straight, for example as illustrated in FIG. 1 the edge 6 of the antenna element 12 may be straight between the part circular sector 18 and the end of the slot 14. Although not illustrated in FIG. 1, a signal cable may be coupled at or near the edge 6 of antenna element 12, for example part way between the part-circular sector and the open end 20 of the slot 14. This may provide a feed point from which the antenna element can be driven and/or from which a signal can be obtained (e.g received) from the antenna element.

The part-circular sector 18 may be arranged to so that, for signals in a communication frequency band of the antenna, the impedance of the conduction path from the feed point towards the closed end 22 of the slot is higher, for example significantly higher, than the conduction path towards the open end 20 for those signals. The conductive material of the antenna element may provide a DC conductive path to ground, around the part circular sector 18.

Where the wall 16 of the recess is curved as illustrated in FIG. 1 and the antenna element 12 edge 6 that is adjacent to the wall 16 is straight, the curvature of the wall 16 causes the slot 14 between antenna element 12 and wall 16 to broaden towards its open end 20 (e.g. towards the mouth of the recess). This is just one example of the shape of a slot 14 between the antenna element 12 and the wall 16, other examples are contemplated.

FIG. 3, shows a series of examples of how the antenna elements and/or walls of the recess may be shaped to provide this slot 14. The illustrations of FIGS. 3-A, 3-B, 3-C and 3-D each represent alternative possible sections through an antenna which may be laid out, when seen in plan, as illustrated in FIG. 2. The examples illustrated in FIG. 3 each show antennas where the slot 14 between the antenna elements and the wall 16 of the recess broadens out towards the mouth of the recess. Depending on the intended use of the antenna one or more of these configurations may be used, for example the configuration may be selected based on the desired shape of the far field radiation pattern. For the configurations illustrated in FIG. 3-A FIG. 3-C, and FIG. 3-D the elevation angle of the pattern may be greater (for example directed more towards the sky, away from the azimuthal plane) whereas for the arrangement illustrated in FIG. 3-B it may be directed slightly towards the azimuth. This may apply to the far field radiation pattern. Each of these examples will now be explained in more detail.

FIG. 3-A shows an antenna comprising antenna elements whose edges adjacent to the recess are straight, but the slope of the edge 6 of the antenna elements differs from the slope angle of the wall 16 to which that edge 6 is adjacent. As a result the spacing between the antenna element 12 and the wall 16 tapers linearly and the open end 20 of the slot 14 is wider than its closed end 22 inside the recess. As illustrated, the antenna elements shown in FIG. 3-A may also comprise a part-circular cut-out arranged towards the interior end of the gap between the edge 6 of the antenna and the wall 16 of the recess where the antenna element 12 is in conductive contact (e.g. DC coupled) with the wall 16. At least part of the slot 14 need not be tapered, for example the edge 6 of the antenna element 12 and the wall 16 of the recess may be parallel with each other along at least a part of the length of the edge 6 and/or the relative angle between the edge 6 of the antenna element 12 and the wall 16 of the recess may change at one or more points along the length of the slot 14. One such example is illustrated in FIG. 3-B. Although not illustrated, it will be clear to a person skilled in the art that the antenna elements 12, 12' in FIGS. 3-A, 3-B, 3-C and 3-D may be DC coupled to the recess, similarly to and as discussed above for FIGS. 1 and 2.

FIG. 3-B shows an antenna comprising antenna elements each of which have a straight edge 6 between the open end 20 of the slot 14 and the part-circular sector 18 at the closed end 22 of the slot 14. Towards the closed end 22 of the slot 14, the wall 16 of the recess is parallel with the edge 6 of the antenna, and towards the open end 20 of the slot 14 the slope angle of the wall 16 of the recess changes (for example increases) so that the wall 16 of the recess diverges from the edge 6 of the antenna element 12. It will be appreciated that in the illustrated example, part of the wall 16 is parallel with the antenna edge 6, but this parallel part of the wall 16 may also be arranged to diverge from the edge 6 of the antenna along the slot 14, for example the divergence between the edge 6 of the antenna element 12 and the wall 16 of the recess may increase at one or more points along the length of the slot 14, for example at two points. In addition, the spacing between the edge 6 of the antenna and the wall 16 of the recess may be stepped, for example the edge 6 of the antenna element 12 and the wall 16 of the recess may be parallel along at least two parts of the edge 6 of the antenna, but the spacing between the wall 16 and the edge 6 of the antenna element 12 may be different in these two parallel parts to provide a slot 14 having a stepped profile. The variation in the spacing and/or divergence between the edge 6 of the antenna element 12 and the wall 16 of the recess may be provided by the form of the wall 16 of the recess, or the form of the edge 6 of the antenna elements, or by a combination of the two. The spacing and/or divergence between the edge 6 of the antenna element 12 and the wall 16 of the recess may be selected to approximate an exponential function of the position along the slot 14.

It can be seen in FIG. 3B that the slope angle of the wall of the recess is shallower towards the open end of the slot than towards the closed end of the slot. This causes the wall 16 of the recess to diverge from the edge of the one antenna element 12. As noted above, the divergence between the edge 6 of the antenna element 12 and the wall 16 of the recess may increase at one or more points along the length of the slot 14, for example at two points. As illustrated in cross section in FIG. 3B, the wall may be planar (e.g. flat) between those points. The wall shown in FIG. 3B comprises a first planar part towards the closed end of the slot, and a second planar part between the first planar part and the open end of the slot. The second planar part diverges from the edge of the antenna element more than the first planar part. As a result, in the example shown in FIG. 3B, the divergence between the edge 6 of the antenna element 12 and the wall 16 of the recess increases at one point along the length of the slot. There may however be more of these points, for example two or more. In which case the wall comprises a third planar part, between the second planar part and the open end of the slot. This third planar part may diverge from the edge of the antenna element more than the second planar part.

Figure 13:
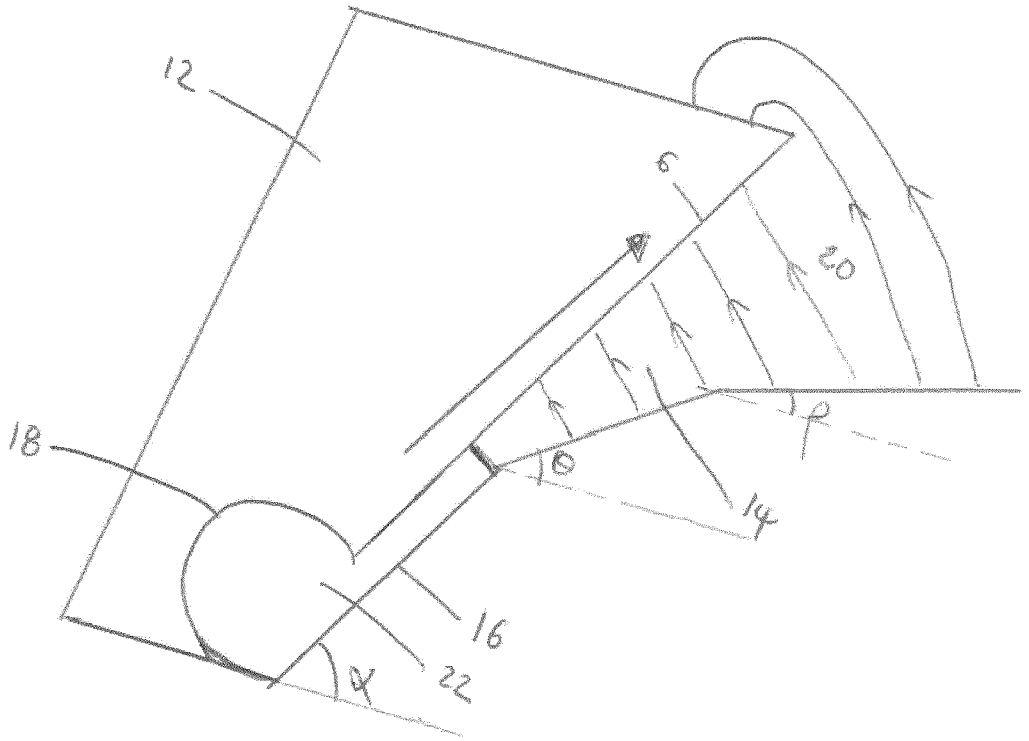
FIG. 13 shows an illustration of a section through an antenna.

FIG. 13 shows an example of an antenna 12, wall, 16, and slot 14 as discussed above.

FIG. 3-C illustrates an example of an antenna in which the edge 6 of the antenna element 12 between the open end 20 of the slot 14 and the part-circular sector 18 at the closed end 22 of the slot 14 is curved. The walls of the recess may be straight, for example they may have a constant slope angle. Towards the closed end 22 of the slot 14, adjacent the part-circular sector 18, the edge 6 of the antenna element 12 may diverge from the wall 16 of the recess very little, for example it may be parallel to the wall 16 of the recess, the edge 6 of the antenna element 12 may however be curved as shown in FIG. 3-C so that the edge 6 of the antenna element 12 diverges more from the wall 16 of the recess towards the open end 20 of the slot 14 (e.g. towards the mouth of the recess) than towards the closed end 22 of the slot 14. This increase in divergence may provide a spacing between the edge 6 of the antenna element 12 and the wall 16 of the recess that increases as an exponential function of the position along the slot 14, for example the edge 6 of the antenna element 12 may follow an exponential curve. Other kinds of curved and straight or partially straight edges may also be used.

FIG. 3-D illustrates an example antenna in which the wall 16 of the recess is straight, e.g. it has a constant slope angle, but the angle of the edge 6 of the antenna varies at one or more points along its length. Along a first part of the edge 6, adjacent to the part-circular sector 18, towards the closed end 22 of the slot 14, the divergence between the antenna element 12 and the wall 16 of the recess may be very small, for example they may be parallel. Further along the edge 6 of the antenna element 12, towards the open end 20 of the slot 14, the angle of the edge 6 of the antenna element 12 may be changed to increase the divergence between the edge 6 of the antenna element 12 and the wall 16 of the recess. It will therefore be seen that the antenna may comprise slots which have one or more linear tapers. The variation in the spacing between the edge 6 of the antenna element 12 and the wall 16 of the recess may be provided by a changes in slope angle of straight parts of the wall 16 of the recess (as in FIG. 3-B), or by changes in slope angle of the edge 6 of the antenna element 12 as in FIG. 3-D, or by a combination of both. In addition, either or both of the wall 16 of the recess (as in FIG. 1) and the edge 6 of the antenna element 12 (as illustrated in FIG. 3-C) may be curved. These different geometries may also be applied to different antenna elements in the same antenna.

Other variations are also within the scope of the appended claims. For example, the example discussed above with reference to FIG. 2 includes four antenna elements, but it will be appreciated that a greater or lesser number of antenna elements may be included.

Figure 5:
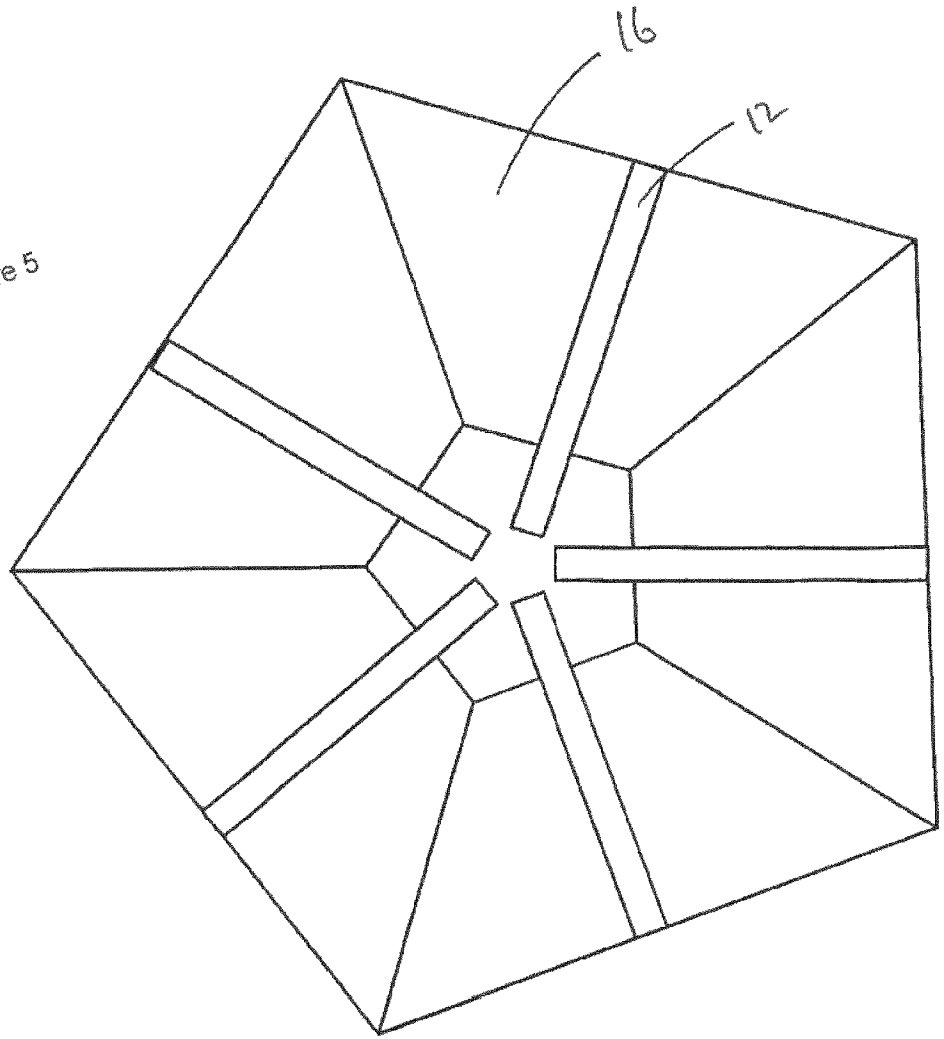
FIG. 5 shows a schematic illustration of a plan view of an antenna.
Figure 4:
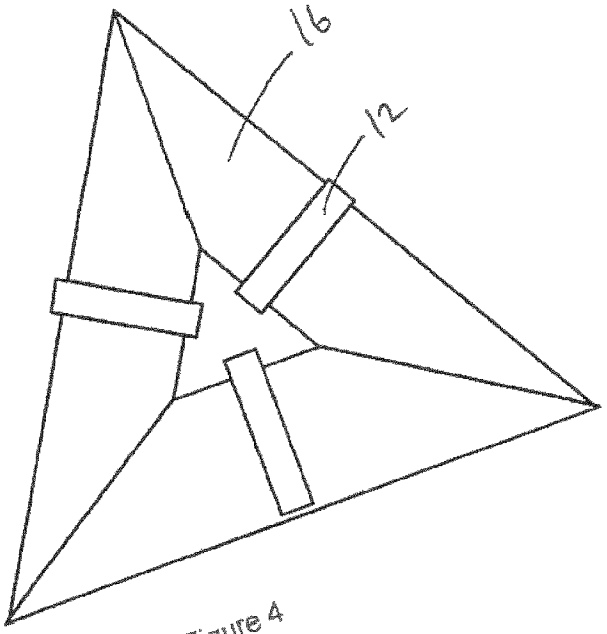
FIG. 4 shows a schematic illustration of a plan view of an antenna.

FIG. 4 shows one such example in which the antenna includes three antenna elements. The recess shown in FIG. 3 comprises an inverted triangular pyramid shape, for example an inverted frusto-pyramidal shape recess. The antenna elements illustrated in FIG. 4 are each oriented so that they are directed away from each other by an angle of 120° when the antenna is viewed in plan. It will be appreciated that antenna elements having different relative orientations may also be used, for example the antenna elements may be directed so that the angle between them is at least 90° as illustrated in FIG. 1, but the angle between them may also be less, for example as illustrated in FIG. 5. It will also be appreciated that different shaped recesses may be used.

FIG. 5 illustrates an example in which the recess comprises a different open polyhedral form from those illustrated in FIG. 2 and FIG. 4. As shown in FIG. 5, the recess may comprise any number of sloping walls, for example five sloping walls, and may be frustrum shaped, for example the base 17 of the recess may be flat or domed. As also illustrated in FIG. 5, the antenna elements may be directed so that the angle between them is less than 90° when the antenna is viewed in plan.

Figures 6, 7:
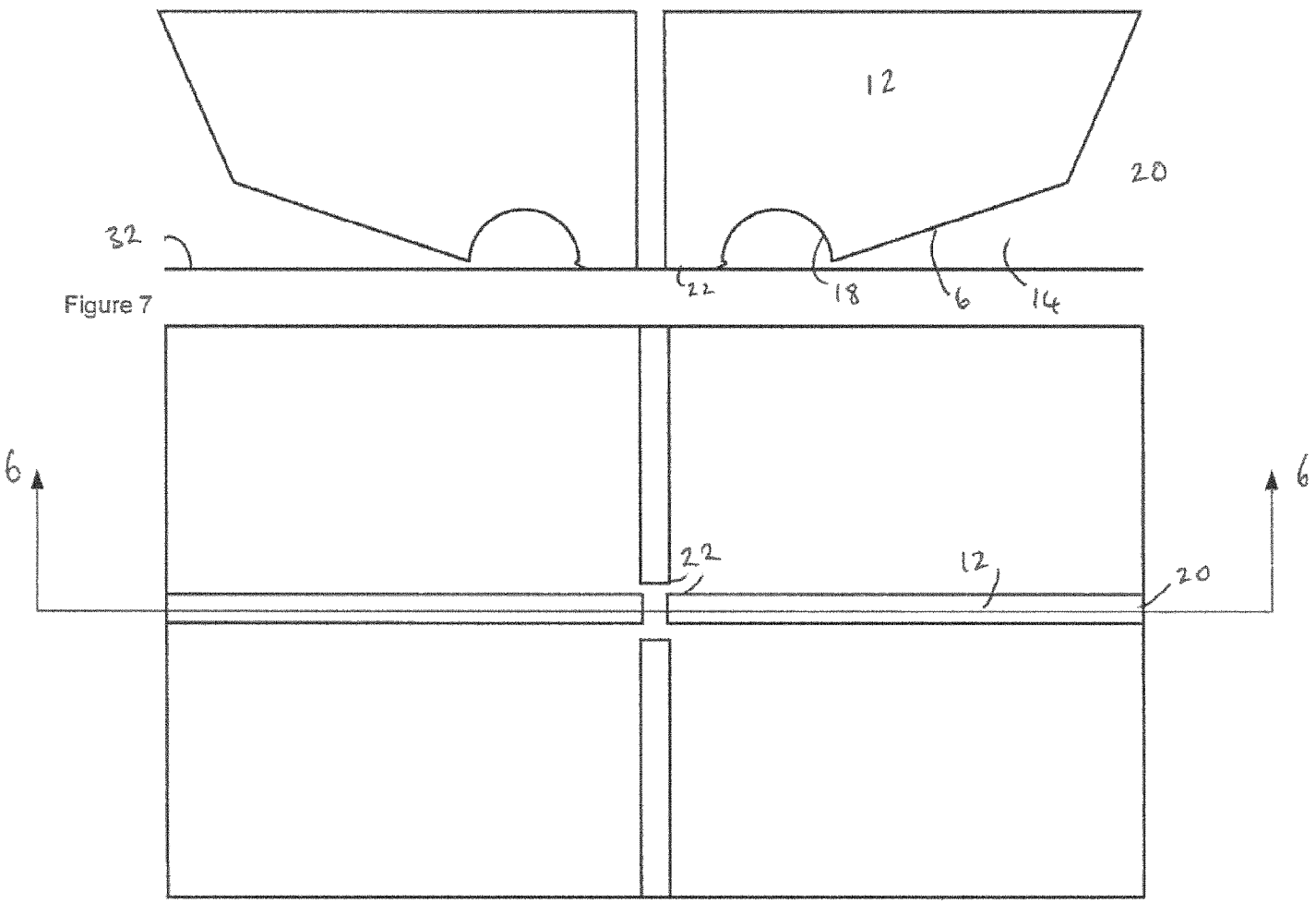
FIG. 6 shows a schematic illustration of a section through an antenna.
FIG. 7 shows a schematic illustration of a plan view of the antenna of FIG. 6.

Other configurations may also be used. For example, in some embodiments the disclosure provides a telecommunications antenna comprising a plurality of antenna elements arranged on a common ground plane 32. As illustrated in FIG. 6, the common ground plane 32 may be flat.

As described above, the edge 6 of each antenna element 12 may be spaced from this common ground plane 32 to provide a slot 14 between the edge 6 of each antenna element 12 and the common ground plane 32. The antenna elements may each comprise conductive plates arranged as half-slot antennas (e.g. half-Vivaldi antennae). As also described above, the slot 14 between the edge 6 of an antenna element 12 and this common ground plane may be closed at one end, for example the antenna element 12 may be DC grounded to the ground plane 32 at the closed end 22 of the slot 14. An impedance tuning structure such as a part circular sector 18 may be arranged towards this closed end 22 of the slot 14 to present a high impedance path to the closed (DC grounded) end of the slot 14 from the edge 6 of the slot 14 further towards the open end 20. This part-circular sector 18 may have the features described above with reference to FIG. 1, FIG. 2 and FIG. 3.

The edges of the antenna elements may be shaped so that the slot 14 between the antenna element 12 and the common ground plane 32 comprises at least one of an exponential curve, a linear taper, and at least one change in the angle of the slot 14 that broadens the slot 14 out towards its open end 20.

It will be appreciated that the slots of the antenna elements may be directed away from each other, for example by an angle of at least 90° when viewed in plan as illustrated in FIG. 7.

Figure 8:
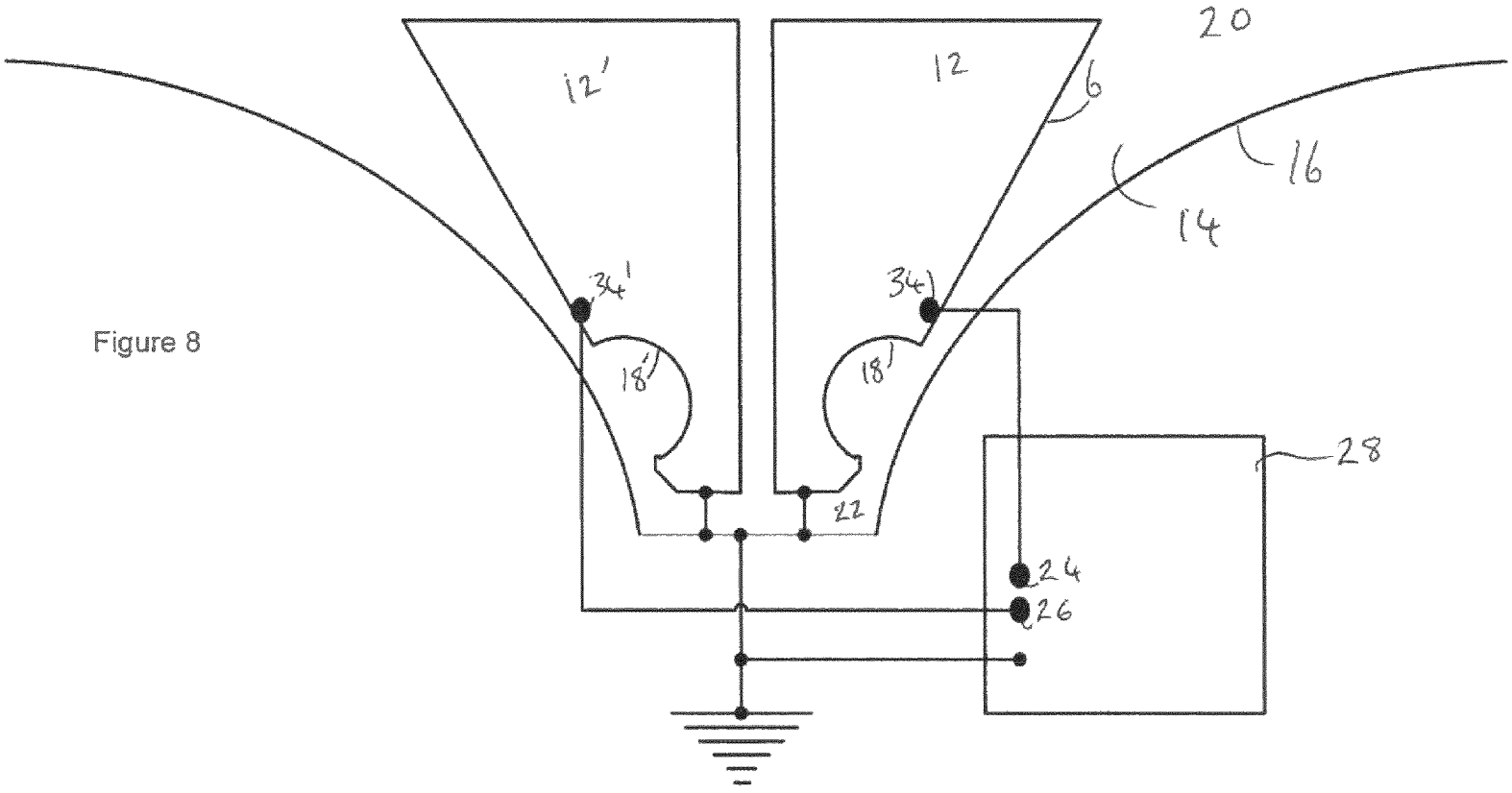
FIG. 8 illustrates one way of coupling the antenna elements to a multi-channel telecommunications apparatus.

Each antenna element 12 may comprise a signal connection arranged to couple an RF signal to or from the antenna, for example from the slot 14. This may comprise a conductive (e.g. ohmic) connection to a signal cable, and the connection may be arranged near the edge of the antenna element 12 that is adjacent to the ground plane 32, for example the connection may be disposed on one of the major surfaces of the antenna element 12 and it may also be on the edge 6 of the antenna element 12.

Where the antenna comprises a plurality of antenna elements, these may each be coupled to a separate transmit and/or receive channel of a telecommunications apparatus for transmitting and/or receiving signals. FIG. 8 shows a schematic illustration of one possible way of connecting the antennas of the present disclosure for transmitting and receiving signals.

FIG. 8 shows a schematic view of a telecommunications apparatus comprising a multi-channel transmitter and/or receiver 28. As illustrated in FIG. 8, the transmitter/receiver 28 may have at least two separate transmit/receive channels 24, 26. Each of these channels 24, 26 may be coupled to transmit and/or receive signals from separate ones of the antenna elements 12, 12' of an antenna such as any one described or claimed herein.

As illustrated in FIG. 8 the walls of the recess comprise conductive surfaces 16 which may be grounded. The antenna elements may be DC coupled to the walls of the recess and/or to ground at the closed end 22 of the slot 14. A transmit/receive coupling may be coupled to each antenna element 12 at a feed point 34, 34' and the part-circular cut out 18, 18' in the slot 14 may be arranged to provide a high impedance in the conduction path to the closed end 22 of the slot 14.

In the context of the present disclosure it will be appreciated that, in the embodiment of FIG. 6 the antenna element is not within a recess. It is also illustrated in FIG. 8 that one or more of the antenna elements may protrude partially beyond the mouth of the recess. For example, an edge of the antenna element (e.g. an outer edge, opposite the slot) may extend out of the recess, for example it may extend beyond the mouth of the recess. It will therefore be understood from a consideration of the drawings that the recess is optional, and where a recess is provided, the antenna elements need not be wholly within that recess.

In some embodiments, the distance between a signal feed-point 34, 34' on the edge of the antenna and the centre of curvature of the part-circular sector 18, 18' may also be selected based on (e.g. to fix) the centre frequency and/or the bandwidth of the communication frequency band of the antenna. For example this distance and the radius may be selected together to provide a desired centre frequency and the bandwidth. In some embodiments the distance from the centre of the circle 18, 18' to the feed point 34, 34' is selected to be one quarter wavelength of the signal at the centre frequency, the radius of the circle may then be selected to provide a desired bandwidth (e.g. the radius may be selected so as to increase the bandwidth around the desired centre frequency). For example: the distance between the feed point and the centre of the circle may be chosen to be about 30 mm a quarter wavelength for a centre frequency of around 2400 MHz. In some examples the radius of the part-circular cut-out may be about 10 mm.

In some embodiments one or more of the antenna elements 12, 12' of an antenna may be configured to have different frequency characteristics. For example, each antenna element 12, 12' may be arranged to support a different part of a required frequency range. For example, the radius of the part-circular sectors 18, 18' of each antenna element may be different to provide antenna elements having different bandwidths. In some embodiments at least one antenna element may be arranged to have a different distance between its feed point 34, 34' and the centre of its part-circular sector 18, 18' than at least one other antenna element 12, 12' so the different antenna elements can accommodate a different part of the bandwidth of the antenna as a whole.

The bandwidths of the different antenna elements 12, 12' may at least partially overlap, or may be distinct, for example non-overlapping.

In some embodiments the orientation and/or the spacing between the antenna elements 12, 12' may be selected to adjust, for example to reduce, the degree of electromagnetic coupling between the antenna elements.

Figure 9A:
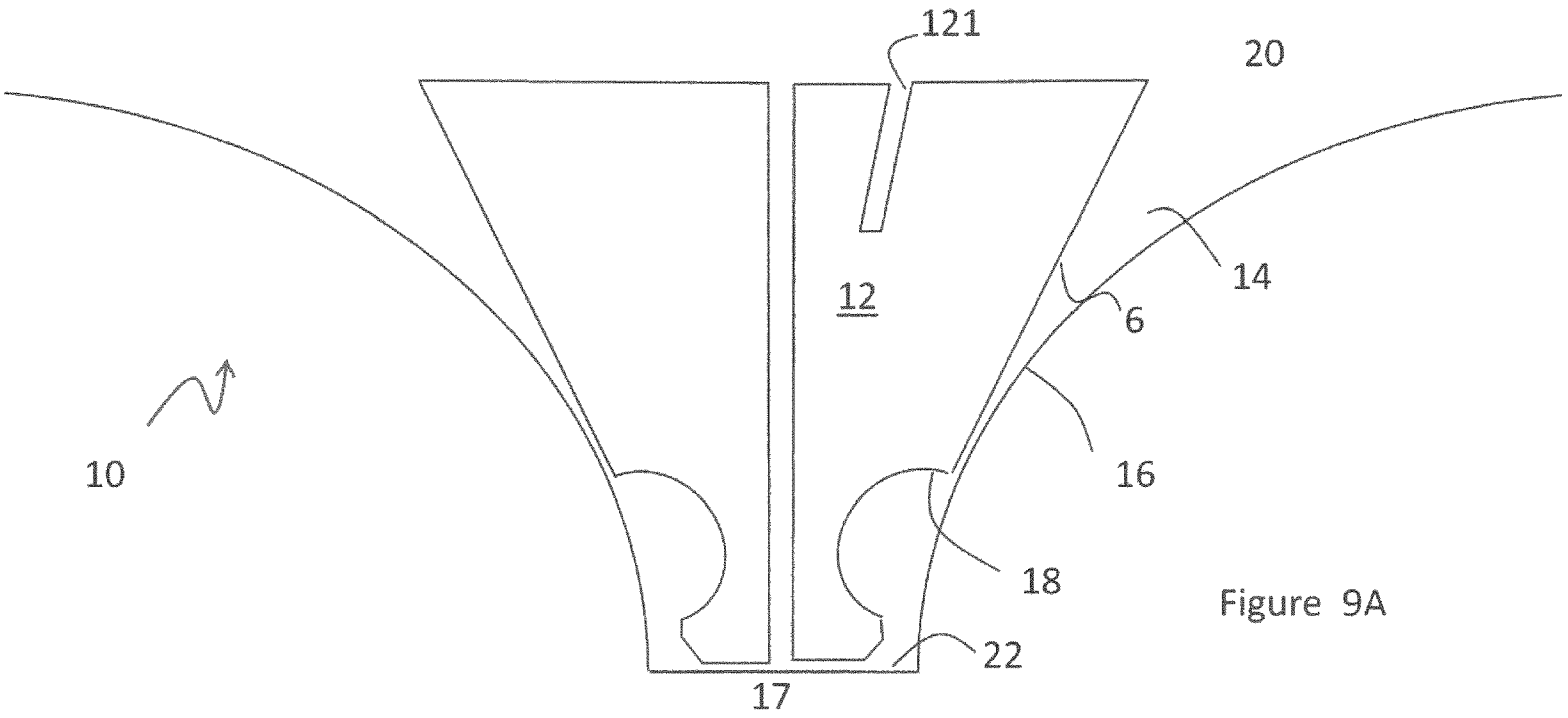
FIG. 9A shows a schematic illustration of a section view through an antenna.

FIG. 9A an example of an antenna such as that illustrated in FIG. 1 and as described with reference to that drawing. In FIG. 1 and FIG. 9A, like elements are marked with like reference numerals.

It will be appreciated that the antenna elements 12 each comprise a conductive planar body, which may be provided by a metal plate. At least one of these antenna elements 12 may comprise an elongate conduction inhibitor, for example a gap in its conductive body.

These conduction inhibitors may be arranged to inhibit the flow of longitudinal surface current on the conductive body, for example along the outer edge of the antenna element that is furthest from (e.g. on the opposite side of the antenna element, away from) the base 17 of the recess. One example of such a current inhibitor is illustrated in FIG. 9A.

In the example illustrated in FIG. 9A, the conduction inhibitor 121 is shown as a gap, for example an air gap. Such gaps may be elongate, for example they may be longer than they are wide, for example in the form of a slot. In FIG. 9A the elongate gap is shown extending to the outer edge of the antenna element. Slots like this one can be arranged transverse to this outer edge, for example the length of the slot may be aligned with the edge 6 of the antenna element which is closest to the wall 16 of the recess 14. For example the slot can be approximately parallel to that edge 6.

Figure 9B:
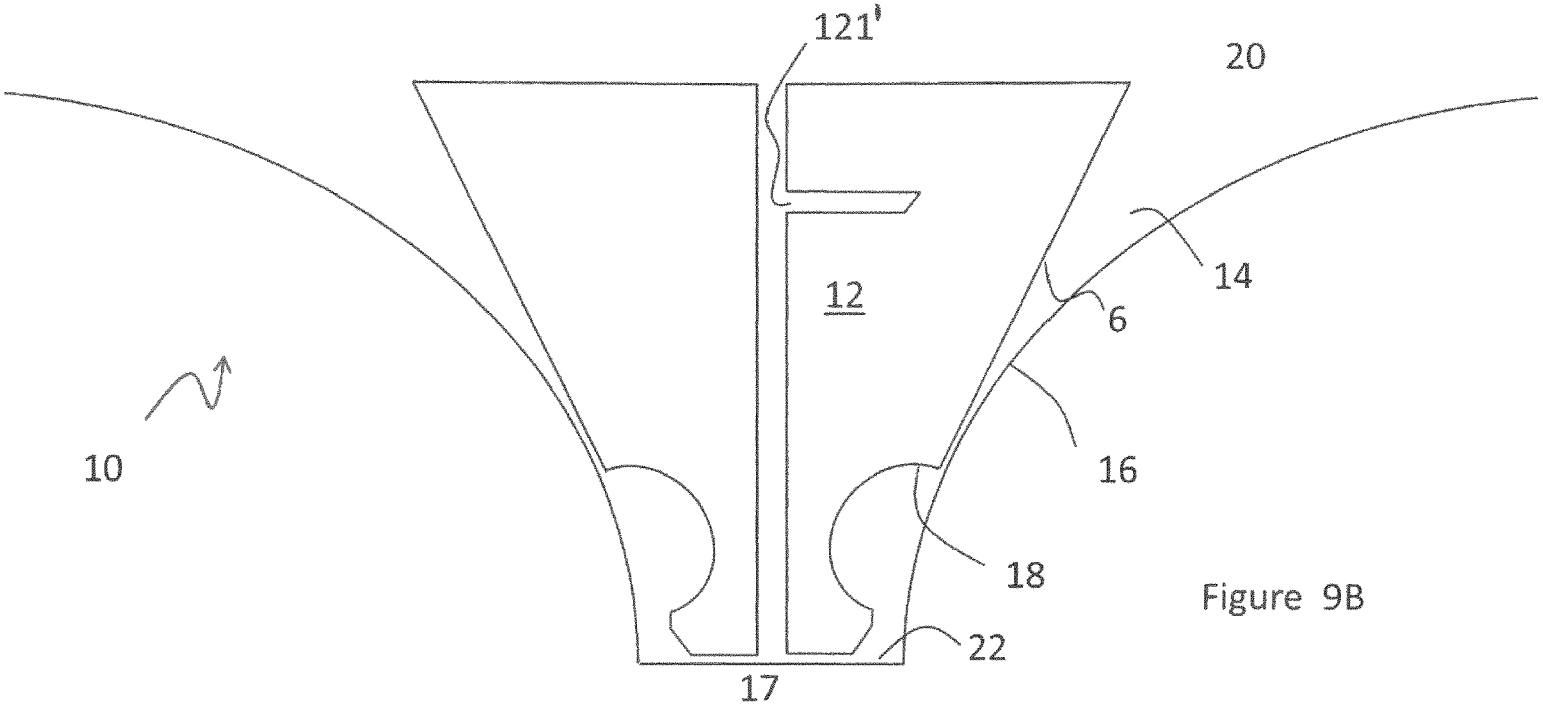
FIG. 9B shows a schematic illustration of a section view through an antenna.

FIG. 9B illustrates another example of an antenna. It can be seen from FIG. 9B that the antenna of FIG. 9B is another example of the kinds of antennae illustrated in the other drawings, and FIG. 9A in particular.

In the example of FIG. 9B at least one of the antennae elements comprises a current inhibitor that is arranged to inhibit the flow of longitudinal surface currents from flowing in the direction of the back edge of that antenna element (e.g. the edge of the antenna that is inside the recess, opposite to the edge 6 that is closest to the wall of the recess). It can be seen in FIG. 9B that, as in FIG. 9A, this current inhibitor can also be provided by a gap, such as a slot, in the conductive body of an antenna element 12.

This current inhibiting slot may be transverse to the inner edge of the antenna element. As a result, in the arrangement illustrated in FIG. 9B, the slot is also aligned with the outer edge of the antenna element 12. It can be seen in the illustration in FIG. 9B that the end of this slot may not be perpendicular to its sides. For example, the end may be angled. In other words, the long side walls of the slot may transverse to the inner edge while its (shorter) end wall can be aligned with the edge 6 of the slot that is closest to the edge of the recess.

In one example of such an arrangement, an antenna element 12 is modified by an elongated recess or slot 121'. This slot 121' may be an essentially horizontal cut approximately parallel to the upper edge 6 through the vertical edge juxtaposed to the edge 6 of the antenna element 12.

Pursuant to the present disclosure it has been found that, whilst longitudinal surface currents along the edge 6 of the antenna element 12 could be regarded as being part of the desired emission characteristics or emission pattern of the antenna, longitudinal surface currents along other edges do not contribute to the desired emission. Current inhibitors, such as recesses or cuts in these edges may control (e.g. confine, e.g. reduce) such unwanted longitudinal surface currents. The impact on the confinement of the longitudinal surface current of a horizontal slot 121' such as that illustrated in FIG. 9B is typically larger than that of a vertical slot 121 illustrated in FIG. 9A.

In some examples the width of the slot 121, 121' of the current inhibitor may be selected so as to inhibit (e.g. confine) unwanted longitudinal surface current whilst maintaining the bandwidth of the antenna, for example the slot may be narrow so that they do not unduly reduce the conductive surface area of the antenna element. Pursuant to the present disclosure it has been appreciated that reducing the area of the antenna element (which is used for accumulation of charges), may have an undesirable effect on bandwidth. The antenna element may be referred to as a "wing".

In other examples, a current inhibitor, or a slot, 121, 121' may be present in more than one of the antenna elements 12, and may, for example, be disposed upon the antenna elements symmetrically. In one example, the antenna elements 12 may each have a slot 121 therein, similar to that shown in FIG. 9A, but with both elements having complementary slots 121. In another example, the antenna elements 12 may each have a slot 121' therein, similar to that shown in FIG. 9B, but with both elements having complementary slots 121'.

In a further example, each antenna element 12 may have a slot 121, 121' in, with each antenna element having a different shape and/or orientation of slot 121, 121' therein. In a yet further example, each antenna element 12 may have a slot 121, 121' therein such that the slots are symmetrical in nature.

It has also been appreciated that the exact orientation, length and/or the width of the current inhibitors have an impact on the input impedance of the antenna. Embodiments of the disclosure therefore provide a method of designing an antenna.

This method comprises selecting an arrangement of planar, conductive, antenna elements such as those described above, and selecting the arrangement of the wall of the recess, for example selecting the orientation, length and/or the width of a slot in at least one of those antenna elements so as to achieve a desired input impedance of the antenna. This selection may be done empirically, for example by testing a physical antenna, and/or for example by a numerical modelling of the antenna, for example using a finite element model. This method may comprise providing data describing the orientation of such slots for use by a manufacturing apparatus to produce the antennae.

Figure 10:
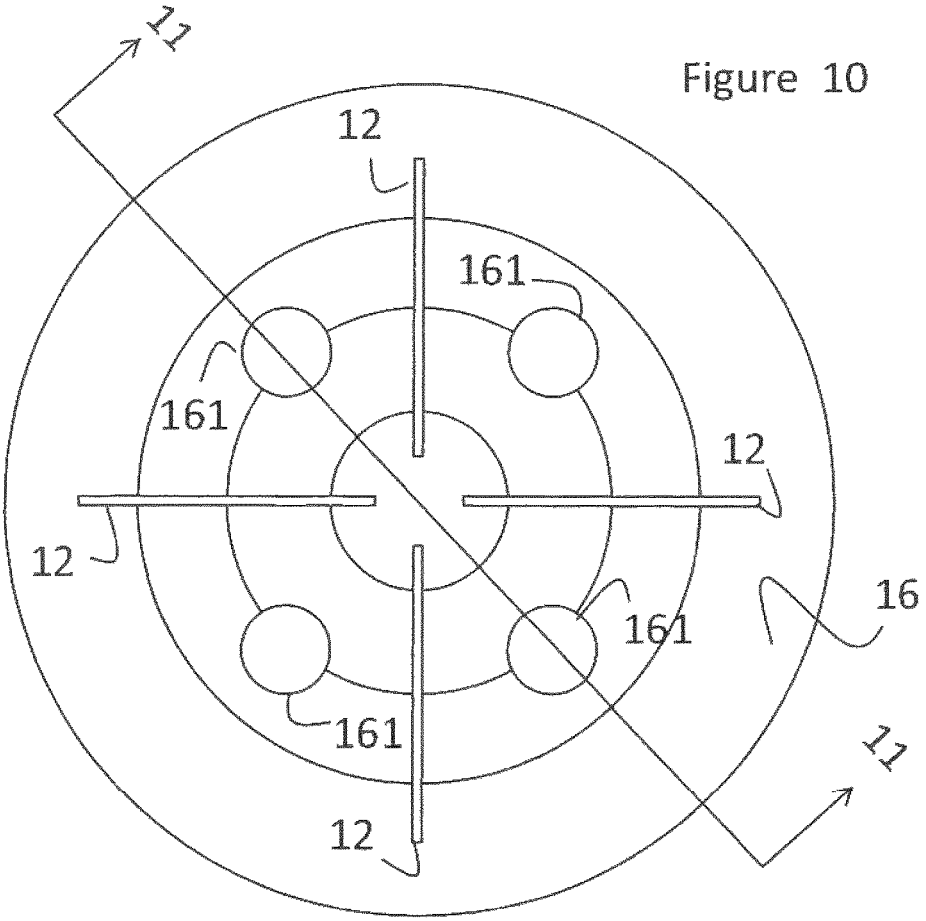
FIG. 10 shows a schematic illustration of a plan view of an antenna.

FIG. 10 is an example of an antenna such as that illustrated in FIG. 1 and as described with reference to that drawing. In FIG. 1 and FIG. 10, like elements are marked with like reference numerals.

FIG. 10 shows an example of an antenna which includes four scatterers 161. It has been appreciated pursuant to the present disclosure that such scatterers can be arranged on the interior surface of the wall 16 of the recess, e.g. the surface facing towards the antenna elements. In this position they can inhibit, for example reduce, the transmission of horizontally polarised signal from the antenna.

Horizontally polarised signals are, in general, generated by the longitudinal surface currents described above. The scatterers 161 may be configured to reflect and scatter a substantial portion of such radiation caused by these longitudinal surface currents. For example the scatterers 161 may be arranged so that they, in general, reflect and scatter horizontally polarised signal.

In the example illustrated in FIG. 10, each of the four scatterers 161 is placed between different neighbouring antenna elements 12. For example, the scatterers and antenna elements are arranged at different, interleaved, angular positions around the wall of the recess 16. The scatterers 161 shown in FIG. 10 stand proud of the wall of the recess and take a generally dome-shaped, for example part-spherical shape, and are spaced at 90° intervals, equidistant between each of the antenna elements 12 which are also spaced at 90° intervals.

It is to be understood that the scatterers 161 may take any suitable shape, which may be, for example, an ellipsoid shape, for example a part-spherical shape, for example a hemisphere. In other examples, the scatterers 161 may take an ovoid shape, for example a part-ovoid shape, for example a part-egg shape. Yet further examples of the scatterers 161 may take for example a geometric shape, for example a part polyhedron such as a dodecahedron. Additional examples of the scatterers 161 may take the form of a more general protuberance, for example a cylinder shape, for example a rounded cylinder.

However, it has been found that a generally part spherical shape hemispherical shape is particularly effective in reflecting and scattering a substantial portion of horizontally polarised radiation caused by the flow of longitudinal surface current on the or each antenna 12. Of course, it is to be appreciated that the shape of the scatterers 161 is selected based upon the intended frequency range, bandwidth, and size of the antenna.

In addition, it has been found that in placing scatterers 161 on the wall 16 of the recess, undesirable horizontally polarised signals emanating from the antenna may be reduced and, for example, converted into vertical polarisation. It has been found that in the case of antennas of this type, vertical polarisation is more advantageous than horizontal polarisation.

Figure 11:
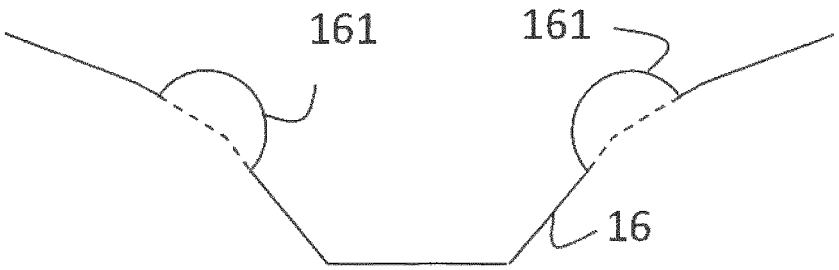
FIG. 11 shows a section view of the antenna illustrated in FIG. 10.

FIG. 11 shows a section along line 11-11 in FIG. 10, and shows the profile of two of the scatterers 161. As can be seen in FIG. 11, and discussed above, the scatterers 161 are grounded, and in this example, are formed as part of the base 16 of the antenna. In other examples, the scatterers 161 may be affixed to the base 16, for example by a method of attachment, for example by welding.

Further, in the example shown in FIG. 11, it can be seen that the scatterers 161 are arranged on the base 16 such that they are located outside the circular cut-out 18 of the or each antenna element 12. For example they may be further from the base of the recess, and nearer to its mouth, e.g. at a greater radial distance from the base than the cut-out 18 of the or each antenna element 12.

Pursuant to the present disclosure it has been found that, whilst longitudinal surface currents along the edge 6 of the antenna element 12 could be regarded as being part of the desired emission characteristics or emission pattern of the antenna, longitudinal surface currents along other edges do not contribute to the desired emission. Scatterers 161, such as the hemispherical scatterers 161 discussed above may serve to mitigate (e.g. confine, e.g. reduce) such unwanted longitudinal surface currents.

In some examples, particularly where the size of the antenna is limited, the scatterers 161 may be placed within the reactive area around the antenna elements 12. In such cases, the scatterers 161 may have an effect upon the coupling between adjacent antenna elements 12. Pursuant to the present disclosure, it has been found that placing the scatterers 161 within the reactive area around the antenna elements may have an undesirable effect on the bandwidth and/or the range of the antenna.

While in the examples above, the conduction inhibitor 121 is shown as being a gap, in other examples the conduction inhibitor 121 may comprise an insert of material, for example a non-conductive material, for example a foam dielectric material. In further examples, the conduction inhibitor may comprise a thinning of the material of the antenna element 12, for example by removing material from the antenna element 12, for example by machining away a portion of the antenna element 12 or otherwise creating an indentation. More than one conduction inhibitor may be provided in each antenna element. Not all of the antenna elements need necessarily comprise conduction inhibitors.

Figure 12:
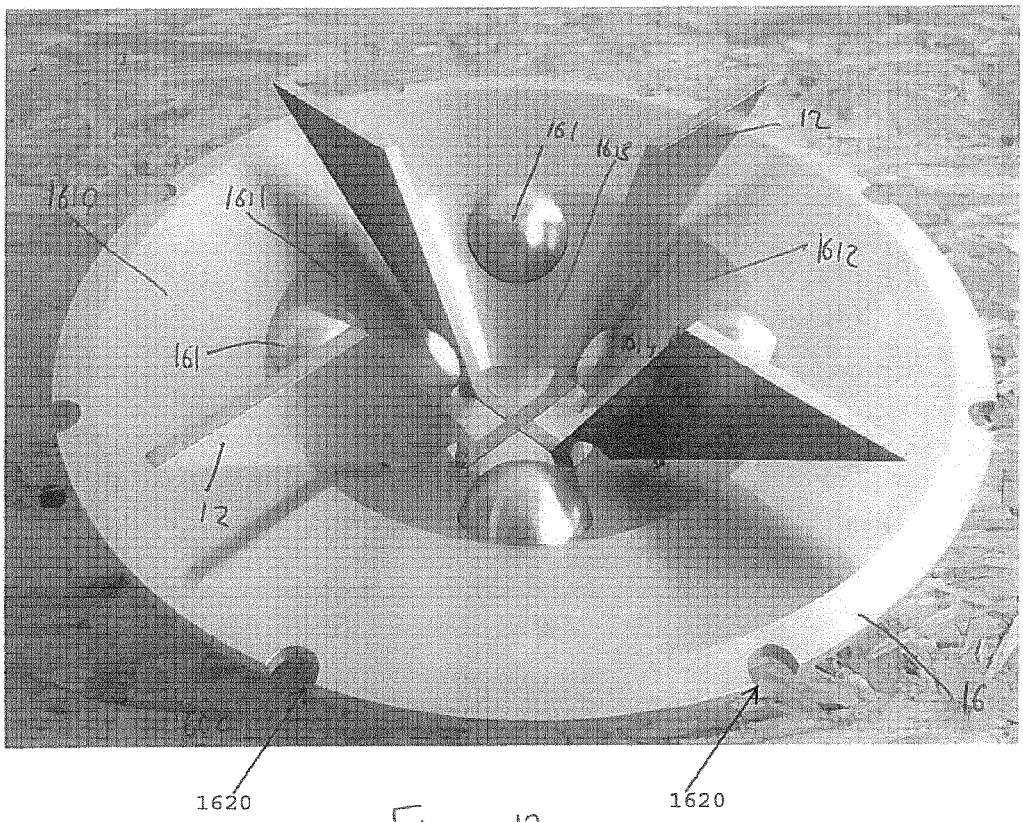
FIG. 12 shows an antenna.

A further example of an antenna is shown in FIG. 12. The antenna of FIG. 12 includes four antenna elements 12, which in the example shown in FIG. 12, are antenna elements 12. The antenna of FIG. 12 also includes four scatterers 161, which in the example shown in FIG. 12 are part-spherical scatterers 161. The antenna shown in FIG. 12 also includes a base 16, which comprises an edge portion 1600, a lip portion 1610, a sloped portion 1611, and a central portion 1614. The sloped portion 1611 shown in FIG. 12 takes an open frustum shape, and more specifically, takes a two-part frustum shape having an upper section 1612 which is shallower with respect to the central portion 1614 than the lower section 1613.

The four antenna elements 12 are attached to the central portion 1614, spaced evenly at 90° with respect to each other, and the base 16 provides a ground plane for the antenna elements 12. The four part-spherical scatterers 161 shown in FIG. 12 are generally located within the upper part 1612 of the sloped portion 1611 of the base 16, spaced evenly at 90° and interleaved between the antenna elements 12, with each scatterer 161 placed generally mid-way between two antenna elements 12.

In the example shown in FIG. 12, the edge portion of the base 1600 includes evenly-spaced mounting points 1620, which in the example shown in FIG. 12 are semicircular cutouts.

It will be appreciated that FIG. 9A may also be considered as follows—the antenna element 12 is modified by an elongated recess or slot 121. In the example of FIG. 9A, the slot 121 might be considered an essentially vertical cut approximately parallel to the edge 6 through the upper edge of the antenna element 12.

It will also be appreciated that FIG. 9B may also be considered as follows: the antenna element 12 is modified by an elongated recess or slot 121'. In the example of FIG. 9B, the slot 121' might be considered an essentially horizontal cut approximately parallel to the upper edge 6 through the vertical edge juxtaposed to the edge 6 of the antenna element 12.

Whilst longitudinal surface currents along the edge 6 of the antenna element 12 could be regarded as being part of the desired emission characteristics or emission pattern of the antenna, longitudinal surface currents along other edges do not contribute to the desired emission. Recesses or cuts in these edges may be used to control the longitudinal surface currents. The impact of a horizontal slot 121' on the confinement of the longitudinal surface current is typically larger than that of a vertical slot 121. The width of the slot 121, 121' should not be too large as they reduce the area of the wing which is used for accumulation of the charges, which has direct effect on bandwidth. The exact orientation, length and/or the width of the slots on an antenna element have an impact on the input impedance of the antenna and are typically optimised numerically to achieve or retain the desired input impedance.

Another embodiment is shown in FIGS. 10 and 11. In this embodiment, the wall 16 of the recess has frustro-conical shape. Within the recess and located on each side of an antenna element 12 are scatterers 161. The scatterers 161 of the example shown in FIGS. 10 and 11 are dome-shaped protrusions of the wall 16 of the recess. With the exception of these dome-shaped protrusions the wall 16 of the recess consists essentially of three frustro-conical sections with three different slope angles. As shown in FIG. 11 the slope angle of the sections increases towards the centre of the antenna.

The presence of scatterer may be used to reflect and scatter a part of the radiation pattern caused by longitudinal surface current inside the antenna elements. Particularly at higher frequencies the scatterers 161 may be used to maintains the shapes of the emission pattern of the antenna at a shape similar to the case where there is negligible impact of these currents, e.g. at lower frequencies.

Furthermore, choosing a smooth, preferably approximately hemisphere shape for the scatterers 161 can help to partly convert the polarization of the sideways radiated field into a more useful polarization.

To achieve a more compact design of the antenna the scatterers 161 may be located within the space between the antenna elements 12 with each scatterer 161 being shared between two adjacent (in direction of the circumference) antenna elements. However when located close to the centre of the antenna the scatterers may impact the input impedance particularly at lower frequencies and in particular the coupling between the two adjacent antenna elements. Thus, the exact shape, size and/or the location of the scatterers may typically be optimized using numerical methods and simulations. The center of each scatterer in an antenna of frustro-conical shape is best located in the vicinity of the circumference connecting the feedpoints of each antenna element.

In some embodiments antenna elements which are directed away from each other may be coupled to a common transmit/or receive signal.

The communication frequency band of the antenna, and/or of individual antenna elements may comprise one or more frequency bands associated with a telecommunications standard, for example a frequency band associated with the LTE or 3GPP telecommunications standards or with one or more other telecommunications standards and/or protocols.

The above embodiments are to be understood as illustrative examples. Some embodiments have been described an illustrated with a particular number of antenna elements and a particular number of antenna elements, but it will be appreciated that a greater or lesser number of such elements may be used. Further embodiments are envisaged. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

With reference to the drawings in general, it will be appreciated that schematic functional block diagrams are used to indicate functionality of systems and apparatus described herein. It will be appreciated however that the functionality need not be divided in this way, and should not be taken to imply any particular structure of hardware other than that described and claimed below. The function of one or more of the elements shown in the drawings may be further subdivided, and/or distributed throughout apparatus of the disclosure. In some embodiments the function of one or more elements shown in the drawings may be integrated into a single functional unit.

In some embodiments the antenna comprises a dielectric cover, for example a radome. For example, the cover may comprise a material such as fibreglass, the cover may be configured to support sufficient load to enable the antenna to be installed in a load carrying surface such as a roadway or a pavement. For example, the cover may be of sufficient tensile and/or compressive strength to support loads of at least 100 kg, for example at least 200 kg. In some embodiments the cover has a strength and/or thickness selected based at least partially on the width of the recess to enable the cover to support the load associated with a human body or a vehicle such as a car. For example this may be a vehicle weighing at least 10 tonnes, or at least 40 tonnes. In some embodiments the manhole cover may comprise metal instead of dielectric.

The cover may be a manhole cover configured to withstand the application of a load of at least 100 kN, and the cover may be configured to withstand the testing procedures envisaged by standard, EN 124-D400, to its upper face, with the manhole cover laid and may comprise a border (measuring a minimum of 5 mm) around the edge of its lower face when resting in position. Examples of suitable materials may be obtained from Industrie Polieco—M.P.B. S.r.l.—Via E. Mattei 49—25046 Cazzago S. Martino (BS)—Italy. The material of the cover may have a thickness of around 40 mm and can withstand a very high pressure.

It will be understood that antennae described herein provide an antenna comprising at least one antenna element arranged in a recess of a ground conductor, wherein a wall of the recess is arranged so that the recess tapers outward from a narrow base inside the recess to a broader mouth, and the wall is configured to provide a ground plane for the at least one antenna element, and the at least one antenna element comprises a conductive plate arranged perpendicular to the mouth of the recess and to the wall and arranged to provide a slot between the edge of the at least one antenna element and the wall of the recess.

The antenna may be manufactured by assembling pre-manufactured components such as metal plates which may be soldered or welded together. Other methods of manufacture may also be used. For example, the antenna may be manufactured by way of '3D printing' whereby a three-dimensional model of the antenna is supplied, in machine readable form, to a '3D printer' adapted to manufacture the antenna. This may be by additive means such as extrusion deposition, Electron Beam Freeform Fabrication (EBF), granular materials binding, lamination, photopolymerization, or stereolithography or a combination thereof. The machine readable model comprises a spatial map of the object to be printed, typically in the form of a Cartesian coordinate system defining the object's surfaces. This spatial map may comprise a computer file which may be provided in any one of a number of file conventions. One example of a file convention is a STL (STereoLithography) file which may be in the form of ASCII (American Standard Code for Information Interchange) or binary and specifies areas by way of triangulated surfaces with defined normals and vertices. An alternative file format is AMF (Additive Manufacturing File) which provides the facility to specify the material and texture of each surface as well as allowing for curved triangulated surfaces. The mapping of the antenna may then be converted into instructions to be executed by 3D printer according to the printing method being used. This may comprise splitting the model into slices (for example, each slice corresponding to an x-y plane, with successive layers building the z dimension) and encoding each slice into a series of instructions. The instructions sent to the 3D printer may comprise Numerical Control (NC) or Computer NC (CNC) instructions, preferably in the form of G-code (also called RS-274), which comprises a series of instructions regarding how the 3D printer should act. The instructions vary depending on the type of 3D printer being used, but in the example of a moving printhead the instructions include: how the printhead should move, when/where to deposit material, the type of material to be deposited, and the flow rate of the deposited material.

The antenna as described herein may be embodied in one such machine readable model, for example a machine readable map or instructions, for example to enable a physical representation of said antenna to be produced by 3D printing. This may be in the form of a software code mapping of the antenna and/or instructions to be supplied to a 3D printer (for example numerical code).

Other examples and variations are contemplated within the scope of the appended claims.

The invention claimed is:

1. An antenna comprising:

at least two antenna elements arranged in a recess of a ground conductor, a wall of the recess being arranged so that the recess tapers outward from a narrow base inside the recess to a broader mouth to provide an open inverted frustum, the wall being configured to provide a ground plane for the at least two antenna elements, and the at least two antenna elements each comprise a conductive plate arranged perpendicular to the mouth of the recess and to the wall to provide slots between the wall of the recess and the edges of each of the at least two antenna elements.

2. The antenna of claim 1 wherein the antenna further comprises at least two signal couplings each arranged to couple to a corresponding one of the at least two antenna elements to drive said corresponding one of the at least two antenna elements with respect to the ground conductor.

3. The antenna of claim 2 wherein the antenna a) is arranged to provide one receive channel per antenna element, and/or b) is arranged to provide one transmit channel per antenna element, and/or c) is adapted to transmit and/or receive a plurality of independent signals, and/or d) comprises at least four antenna elements to provide a 4×4 MIMO antenna.

4. The antenna of claim 3 wherein the at least two antenna elements are each arranged to provide different bandwidths and/or a different center frequency.

5. The antenna of claim 4 wherein the antenna elements each comprise a part-circular sector, wherein the radius of the part-circular sector of a particular antenna element is chosen to select the bandwidth of the particular antenna element.

6. The antenna of claim 4 wherein the antenna elements each comprise a feed-point for coupling the antenna element to a signal cable, and a part-circular sector, wherein the positioning of the feed-point with respect to the part circular sector is chosen to select the center frequency of each antenna element.

7. The antenna of claim 5 wherein a) the center frequencies of at least two of the antenna elements are different, and/or b) the bandwidths of at least two of the antenna elements are at least partially overlap, and/or c) the bandwidths of at least two of the antenna elements are at least partially different.

8. The antenna of claim 1 comprising at least one half-Vivaldi antenna element arranged in a recess, wherein the recess is configured to provide a ground plane for the at least one half-Vivaldi antenna element.

9. The antenna of claim 8 wherein the at least one half-Vivaldi antenna element is arranged to provide a slot between the edge of the at least one half-Vivaldi antenna element and a wall of the recess, wherein the at least one half-Vivaldi antenna element comprises a conductive plate arranged perpendicular to a mouth of the recess, wherein the slot is directed towards the mouth of the recess.

10. The antenna of claim 8 comprising at least one antenna element arranged in a recess, wherein the recess is configured to provide a ground plane for the at least one antenna element and the antenna element comprises a conductive plate arranged perpendicular to the mouth of the recess and being spaced from a wall of the recess to provide a slot between an edge of the conductive plate and the wall of the recess.

11. The antenna of claim 1 wherein the slot broadens out towards the mouth of the recess so that the shape of the slot comprises at least one of an exponential curve, a linear taper, a stepped profile, and at least one change in the angle of the slot.

12. The antenna of claim 1 comprising at least two of the antenna elements in the recess, wherein the slots of the at least two antenna elements are directed away from each other, wherein the slots are directed in different azimuthal directions, wherein being directed away from each other comprises being directed in orientations which differ by at least 90 degrees.

13. The antenna of claim 1 wherein the wall of the recess comprises a planar face and the at least one antenna element is arranged perpendicular to the planar face, wherein the planar face is tapered from a narrow apex within the recess to a broader base at the mouth of the recess, so that the wall of the recess provides an open polyhedral form.

14. The antenna of claim 1 wherein the wall of the recess comprises a curved face and the at least one antenna element is arranged perpendicular to the curved face.

15. The antenna of claim 14 wherein the curved face has a negative curvature so the sloping of the face is less towards the perimeter of the recess.

16. The antenna of claim 1 wherein the recess is one of: (i) open; and (ii) enclosed by a non-conductive material such as a dielectric radome.

* * * * *